US011554381B2

(12) United States Patent
O'Brien et al.

(10) Patent No.: US 11,554,381 B2
(45) Date of Patent: Jan. 17, 2023

(54) LOCKING DISPENSER FOR A CANISTER

(71) Applicant: AC AVALANCHE LLC, Valley View, OH (US)

(72) Inventors: Stephen William O'Brien, Fort Worth, TX (US); Todd Michael Coleman, The Colony, TX (US); Michael E Quest, Franklin, TN (US)

(73) Assignee: AC Avalanche LLC, Valley View, OH (US)

( * ) Notice: Subject to any disclaimer, the term of this patent is extended or adjusted under 35 U.S.C. 154(b) by 0 days.

(21) Appl. No.: 17/443,452

(22) Filed: Jul. 26, 2021

(65) Prior Publication Data

US 2022/0111410 A1 Apr. 14, 2022

Related U.S. Application Data

(63) Continuation of application No. 17/066,237, filed on Oct. 8, 2020, now abandoned.

(51) Int. Cl.

| | |
|---|---|
| ***B65D 83/20*** | (2006.01) |
| ***B05B 11/00*** | (2006.01) |
| ***B65D 83/24*** | (2006.01) |

(52) U.S. Cl.

CPC ..... *B05B 11/3059* (2013.01); *B65D 83/205* (2013.01); *B65D 83/24* (2013.01)

(58) Field of Classification Search

CPC .... B05B 11/3059; B65D 83/205; B65D 83/24
See application file for complete search history.

(56) References Cited

U.S. PATENT DOCUMENTS

| | | | | |
|---|---|---|---|---|
| 3,323,690 | A | 6/1967 | Monahon | |
| 3,608,785 | A | 9/1971 | Durso | |
| 3,738,537 | A | 6/1973 | Gach | |
| 3,760,988 | A | 9/1973 | Ostrowsky | |
| 3,828,982 | A | 8/1974 | Steigerwald | |
| 4,582,228 | A | 4/1986 | Diamond | |
| 4,830,224 | A * | 5/1989 | Brison | B05B 11/0027 222/402.11 |
| 5,282,551 | A | 2/1994 | Pierson | |
| 6,260,739 | B1 | 7/2001 | Hsiao | |
| 6,302,302 | B1 | 11/2001 | Albisetti | |
| 6,360,554 | B1 | 3/2002 | Trachtenberg | |
| 6,385,986 | B1 | 5/2002 | Ferris et al. | |
| 6,438,970 | B1 | 8/2002 | Ferris et al. | |
| 6,481,221 | B2 | 11/2002 | Ferris et al. | |
| 6,609,385 | B1 | 8/2003 | Ferris et al. | |
| 7,140,515 | B2 * | 11/2006 | Cardwell, III | F41H 9/10 222/402.15 |
| 7,260,943 | B2 | 8/2007 | Carrubba et al. | |
| 7,588,171 | B2 | 9/2009 | Reedy | |
| 9,933,318 | B2 | 4/2018 | Quest | |
| 10,173,492 | B2 | 1/2019 | Quest | |
| 10,571,042 | B2 | 2/2020 | Quest | |
| 10,739,049 | B2 | 8/2020 | Quest | |

(Continued)

*Primary Examiner* — Frederick C Nicolas

(57) ABSTRACT

A dispenser system for a canister. The system includes an actuator and a cover that can prevent inadvertent actuation. The actuator may include a button, a stem connector and an actuator housing. The stem connector may include wings with a protrusion to create a snap-fit with the actuator housing, thereby holding the stem connector in place during operation of the dispenser system.

22 Claims, 15 Drawing Sheets

(56) References Cited

U.S. PATENT DOCUMENTS

| | | | |
|---|---|---|---|
| 2003/0127468 | A1 | 7/2003 | Loghman-Adham |
| 2008/0210710 | A1 | 9/2008 | Marquardt |
| 2014/0374446 | A1 | 12/2014 | Michaux |
| 2015/0368027 | A1 | 12/2015 | Betts |
| 2017/0113510 | A1 | 4/2017 | Quest |

* cited by examiner

LOCKING DISPENSER FOR A CANISTER

FIELD OF THE DISCLOSURE

The application relates generally to actuators for pressurized canisters.

BACKGROUND

Actuators are used to control the outflow of gas or fluid products from pressurized containers—such as aerosol cans. The actuator is designed to facilitate gas or fluid flow from the pressurized container to another location. The actuator may be designed to release the pressurized gas or fluid from an attached container when the actuator is depressed. When the actuator is released, the actuator stops the release of pressurized gas from the canister.

SUMMARY

The present disclosure provides an actuator that may be locked in a depressed position, allowing the contents to be discharged without requiring the user to hold the actuator down. The actuator includes secondary buttons to release the actuator from a depressed position, causing the contents to stop discharging. This allows the user to engage and discharge the canister contents without holding the button the entire time and stop the discharge when done by pressing the secondary buttons.

In some embodiments, the actuator design includes an actuator housing, a stem connector, a button and a nozzle. These features may be separate or integrated into common components. In some embodiments, certain components may be configured to specific canister designs while the remaining components are universal. The stem connector may be designed to fit over an extended stem from a canister. In other embodiments, the stem connector may include a valve stem that extends into the canister.

In some embodiments, the stem connector includes one or more wings. The wings may include locking protrusions, tabs or hooks on the arms and plates at the ends, which operate as secondary buttons. The tabs may mate with corresponding tabs on the actuator housing to hold the stem connector in a depressed or open state for the valve stem to control the release of contents from the canister. When the tabs are not mated, the stem connector is not creating an open state for the valve stem to release the contents. A user may release the mated tabs by squeezing the plates on the ends of the wings.

In some embodiments, a cover attaches to the top of the actuator to prevent the button from accidental actuation. The cover may be configured to slide around the wings. In addition, the cover may include a section to hold additional items or show marketing information.

In some embodiments, the canister may include a shroud extending from the actuator housing over a top portion of the can. The shroud may conceal all or part of the actuator housing and may provide additional advertising space. In some embodiments, the shroud may be designed to hold a component.

In some embodiments, the canister may include a hose attached to the nozzle. The body of the hose may be held in place against the canister for transport and display. In other embodiments, the hose may be wrapped around the actuator and stored within a cap or other covering feature to maintain a cylindrical shape. This may reduce the shipping, storage and display space needed for the canister.

A BRIEF DESCRIPTION OF THE DRAWINGS

Embodiments will now be described, by way of example only, with references to the accompanying drawings in which.

DETAILED DESCRIPTION

Figure 1:
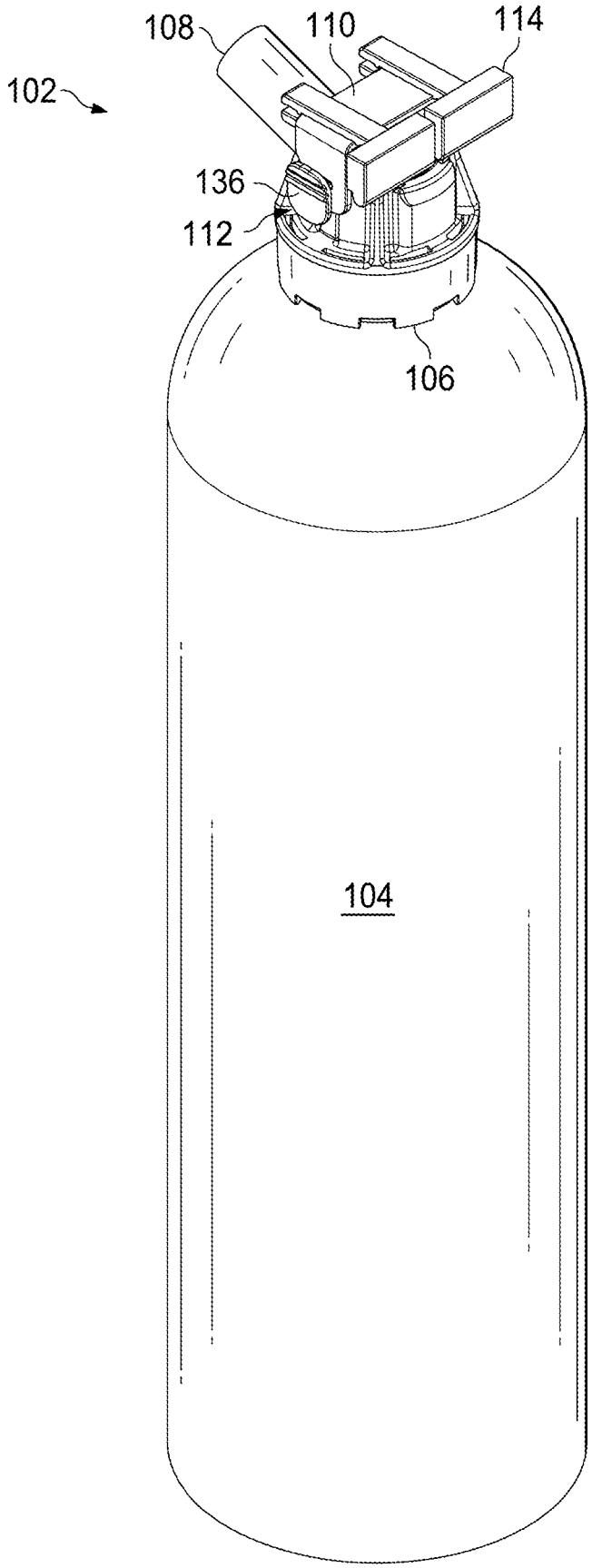
FIG. 1 is a perspective view of an embodiment of an actuator on a canister.

While this device may be embodied in many different forms, there will herein be described in detail preferred embodiments with the understanding that the present disclosure is to be considered as an exemplification of the principles of the device and is not intended to limit the broad aspects of the embodiments illustrated. It will be understood that the device may be embodied in other specific forms without departing from the spirit or central characteristics thereof. The present embodiments, therefore, are to be considered in all respects as illustrative and not restrictive, and are not to be limited to the details given herein.

FIGS. 1 through 6 depict a dispenser system for a canister 104. The canister 104 holds contents under pressure that escape when a valve stem provides an open state to discharge the contents. The dispenser system includes an actuator 102 and actuator cover 110. The actuator 102 may include a valve stem or engage a valve stem that is built into the canister 104. In this embodiment, the dispenser system also includes a tube 108 that directs the outflow of contents from the canister 104 to a desired location. This embodiment also includes accessory items 114 clipped onto the actuator cover 110.

Figure 2:
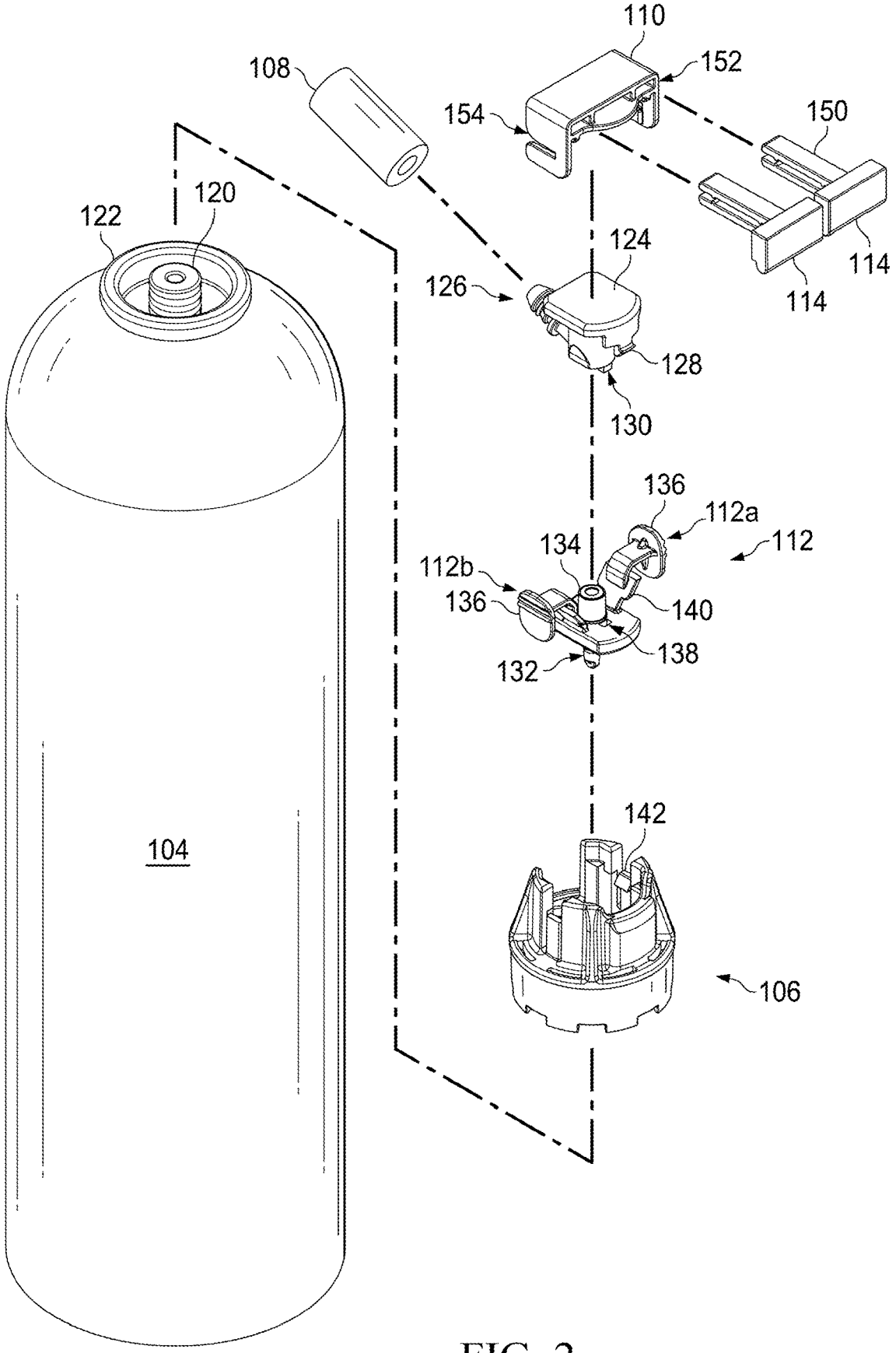
FIG. 2 is an exploded view of an embodiment of an actuator and a canister.

The exploded view in FIG. 2 illustrates the relationship of the various components. The canister 104 includes a mounting cup 122 with an internal ste, gasket 120. The actuator 102 includes an actuator housing 106, stem connector 112 (having one or more wings 112*a*, 112*b*) and button 124.

In some embodiments, the button 124 includes a nozzle 126, a snap fit protrusion 128 and guide 130. The tube 108 connects to the nozzle 126. The direction in which the nozzle 126 extends will be referred to as forward for context. The snap-fit protrusion 128 is located on the back of the button 124.

In some embodiments, the stem connector 112 includes a valve stem 132, a button coupling 134, wings 112*a*, 112*b* including plates 136 and wing protrusions 140. The stem connector 112 also includes a guide hole 138 that corresponds with the guide 130 on the button 124. The guide 130 and guide hole 138 assist in aligning a port in the bottom of the button 124 with the button coupling 134.

The actuator housing 106 connects to the mounting cup 122 on the canister 104. In some embodiments, the actuator housing 106 includes housing protrusion 142, which corresponds with the wing protrusion 140 on stem connector 112.

The actuator housing 106 includes a base and vertical walls. The vertical walls create an open area to accept the button 124 and stem connector 112. The front section is open to allow the nozzle 126 to extend forward from the actuator housing 106 and connect to the tube 108. In some embodiments, the vertical walls are around three sides of the open area. In other embodiments, additional openings in the vertical walls may be included. The side walls may include notches or openings corresponding to the wings of the stem connectors. The housing protrusion 142 may be located directly below the notch in the vertical side wall.

The actuator cover 110 includes wing slots 154 that slide over the wings between the plates 136 and the wing protrusions 140. When the actuator cover 110 is in place, the button 124 is protected from inadvertent actuation. The actuator cover 110 also includes opening 152 in the top section that may hold accessory items 114. The accessory items 114 may each include an extended clip 150 to grip the openings 152.

The accessory items 114 may contain marketing information or be components for use with the canister 104. For example, the accessory items 114 may be sensor components, such as thermochromic materials that change color based on temperature. For automotive refrigerant products, the user may place the accessory items 114 in a vent of a vehicle using the extended clip 150 to grip the vent. During operation, the user may use the canister to charge refrigerant while the vehicle air conditioning is running, until the accessory items 114 change color.

Figure 3:
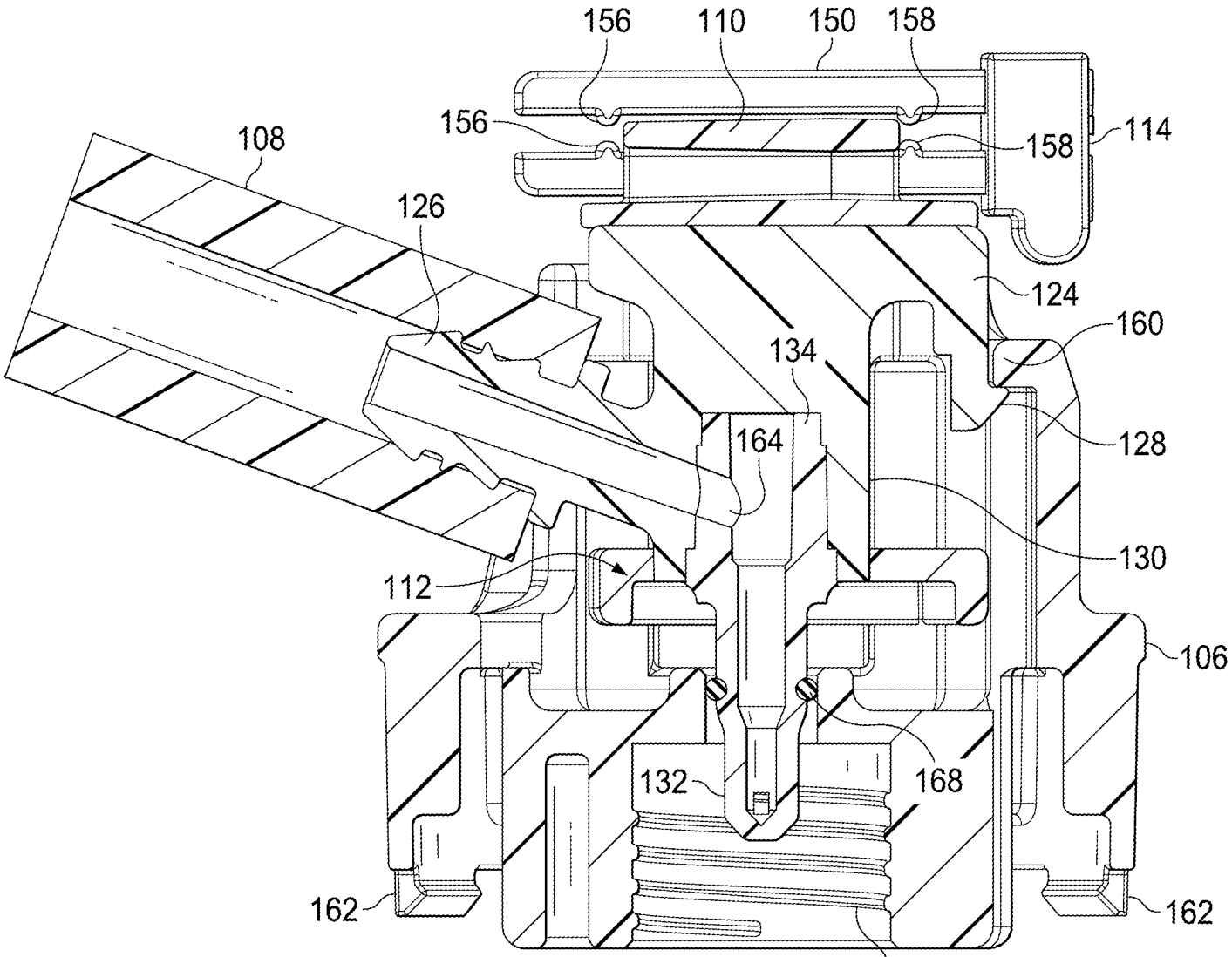
FIG. 3 is a side, cross-section view of an actuator.

FIG. 3 illustrates a side, cross-section view of the assembled actuator 102 with the actuator cover 110. In this embodiment, the actuator 102 is formed by the stem connector 112, the actuator housing 106 and the button 124. The stem connector 112 fits within the actuator housing 106. The button 124 attaches to the button coupling 134 on stem connector 112 within the actuator housing 106.

In some embodiments, the actuator housing 106 includes an extension 160 at the top and back. When the button 124 is pressed into the actuator housing 106, the snap-fit protrusion 128 snaps over the extension 160 on the top of actuator housing 106. Once in place, the hook of the snap-fit protrusion 128 catches the extension 160 to prevent or limit the ability of the button 124 to be removed from the actuator housing 106.

In this embodiment, the actuator housing 106 includes hooks 162 at the outer edge of the base that form a snap fit over the outer edge of the valve cup 120 of the canister 104. In addition, this embodiment includes a threaded connection 166, which connects to the internal stem gasket 120. In this embodiment, the threaded connection 166 is a right-hand threaded connection. In some embodiments, the threaded connection 166 may be a left-hand threaded connection. For some products, the thread direction may correspond to the product in the canister 104. For example, the threaded connection 166 may be right-hand threaded for r134a refrigerant and left-hand threaded for r1234yf refrigerant.

In some embodiments, the actuator housing 106 may use only one canister connection to hold onto the canister 104. For example, the actuator housing 106 may only include the threaded connection 166 in some embodiments. In some embodiments, the actuator 102 may include an O-ring, a gasket or other seal between the canister 104 and the actuator housing 106 to prevent or limit leakage from the actuator 102 connection.

When the actuator 102 is assembled, the button 124 is engaged with the button coupling 134 of the stem connector 112. The stem connector 112 includes the valve stem 132 that enters the internal stem gasket 120 when attached to the canister 104. A seal 168 is shown as an O-ring in this embodiment. The seal 168 is located in a groove around the valve stem 132. The seal 168 is compressed between the valve stem 132 and the internal stem gasket 120 and operates to prevent the escape of the canister 104's contents to and around the valve stem 132. The valve stem 132 is used to control the release of contents from the canister 104. The valve stem 132 allows the release of contents when depressed and does not release contents when raised.

When the valve stem 132 is depressed by the button 124, contents from the canister 104 pass through the internal pathway of the valve stem 132 to fluid opening 164 in the side of the button coupling 134. The fluid opening 164 aligns with the internal pathway of the nozzle 126, allowing the contents to pass through the nozzle 126 and into the tube 108.

The actuator cover 110 is shown at the top over the button 124. The accessory item 114 is shown clipped into the opening 152 with one arm of the extended clip 150 above the actuator cover 110 and the second arm in the opening 152. The extended clip 150 includes corresponding forward protrusions 156 and rear protrusions 158 on each arm. The protrusions 156 and 158 coordinate to grip the actuator cover 110. The protrusions 156 and 158 may also be used to grip other things, such as a vehicle vent. In some embodiments, the forward protrusions 156 may be larger than the rear protrusions 158. In such embodiments, the forward protrusions 156 may clip behind a structure while the rear protrusions 158 grip the structure.

When the actuator cover 110 is in place, the button 124 and stem connector 112 are held in a raised position to prevent accidental or inadvertent release of the contents of the canister 104. In addition, the actuator cover 110 may limit the ability to tamper with the canister 104 to release the contents. The wing slots 154 of the actuator cover 110 may prevent the wings 112*a*, 112*b* from being compressed due to the width of the actuator cover 110.

Figure 4:
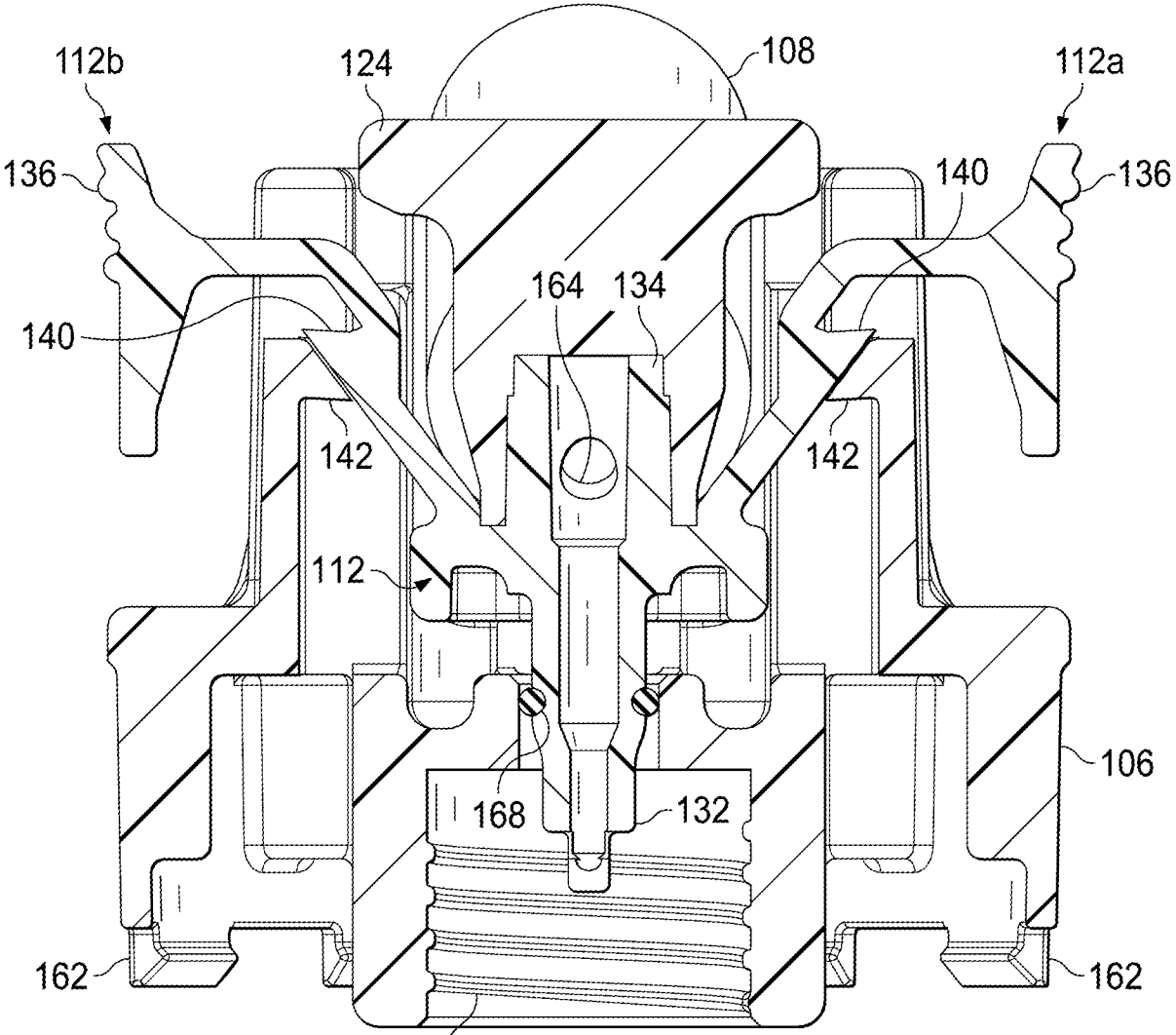
FIG. 4 is a back, cross-section view in a first position.
Figure 5:
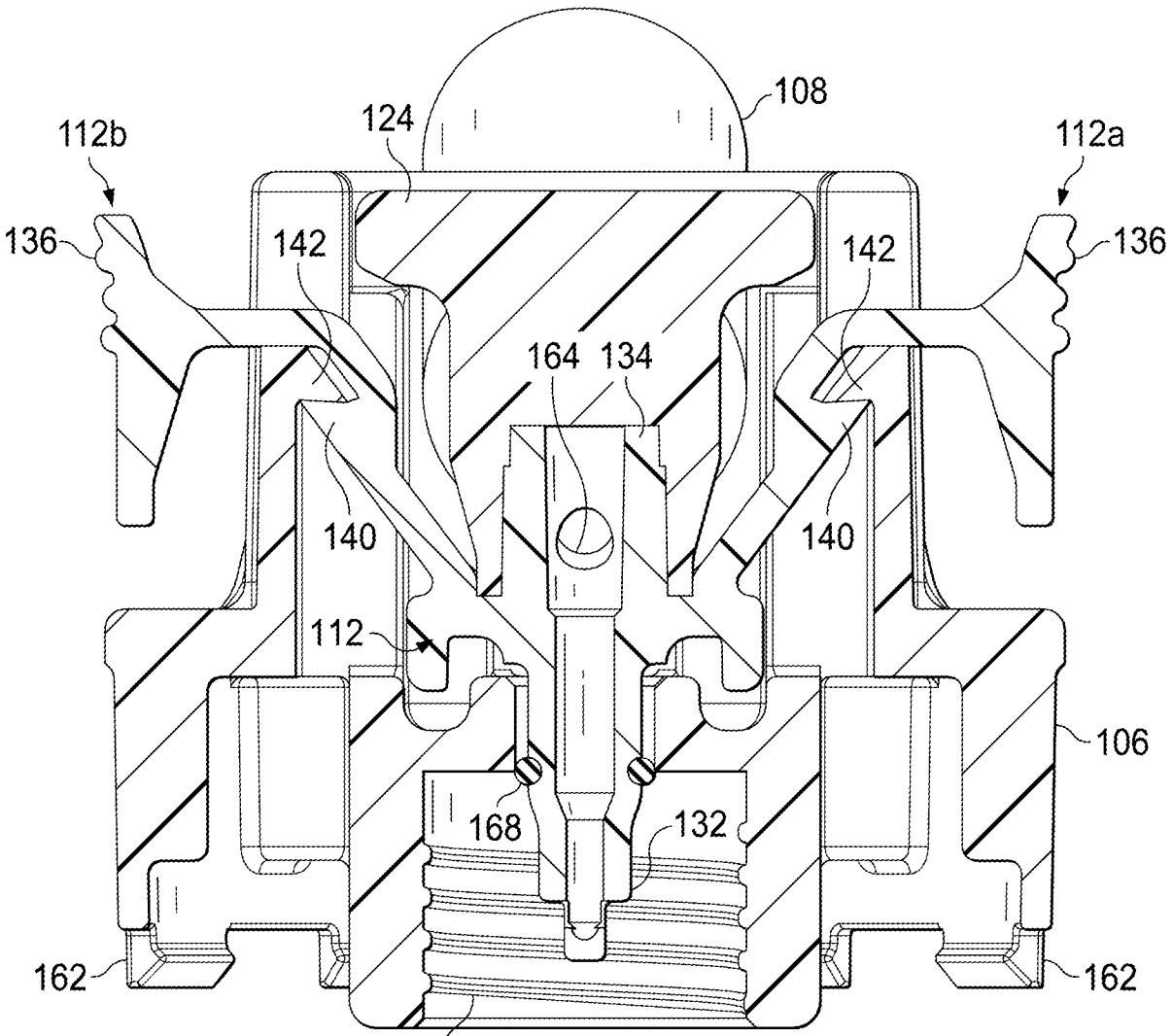
FIG. 5 is a back, cross-section view in a second position.

FIGS. 4 and 5 illustrate back, cross-section views in a raised position (FIG. 4) and a depressed position (FIG. 5). In these views, the actuator cover 110 has been removed to allow access to the button 124 and allow the wings to compress in order to lower or raise the button 124. The actuator housing 110 is shown with a pair of housing protrusions 142, which correspond with the wing protrusions 140. In some embodiments, the housing protrusions 142 form a hook feature with a wider base than top. Similarly, the wing protrusions 140 form an opposing hook feature with a wider top than base. The abutting sides of the protrusions 140 and 142 are angled to allow the wings to slide downward when the button 124 is pressed.

As shown in FIG. 5, once the wing protrusions 140 pass the housing protrusions 142, the wings expand, causing the hook features to engage and prevent the button 124 or stem connector 112 from returning to a raised position automatically. When the wing protrusions 140 and housing protrusions 142 are engaged, the actuator 102 continues to release the contents from the canister 104 without requiring the user to hold the button 124 down.

A user may stop the release of contents from the canister 104 by pressing the plates 136 inward, causing the wing protrusions 140 to disengage the housing protrusions 142. Once disengaged, the pressure from the canister 104 may push the stem connector 112 upward absent any downward pressure applied by the user. The contents will stop dispensing from the canister 104 when the stem connector 112 returns to the raised position.

Figure 6:
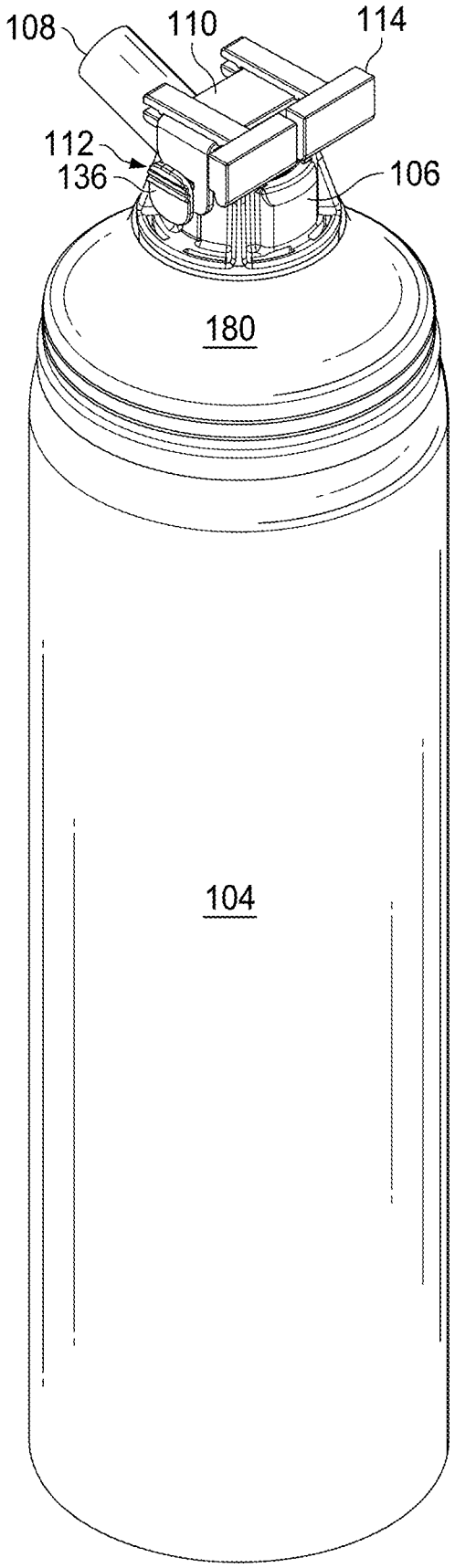
FIG. 6 is a perspective view of an embodiment of an actuator with a shroud on a canister.
Figure 7:
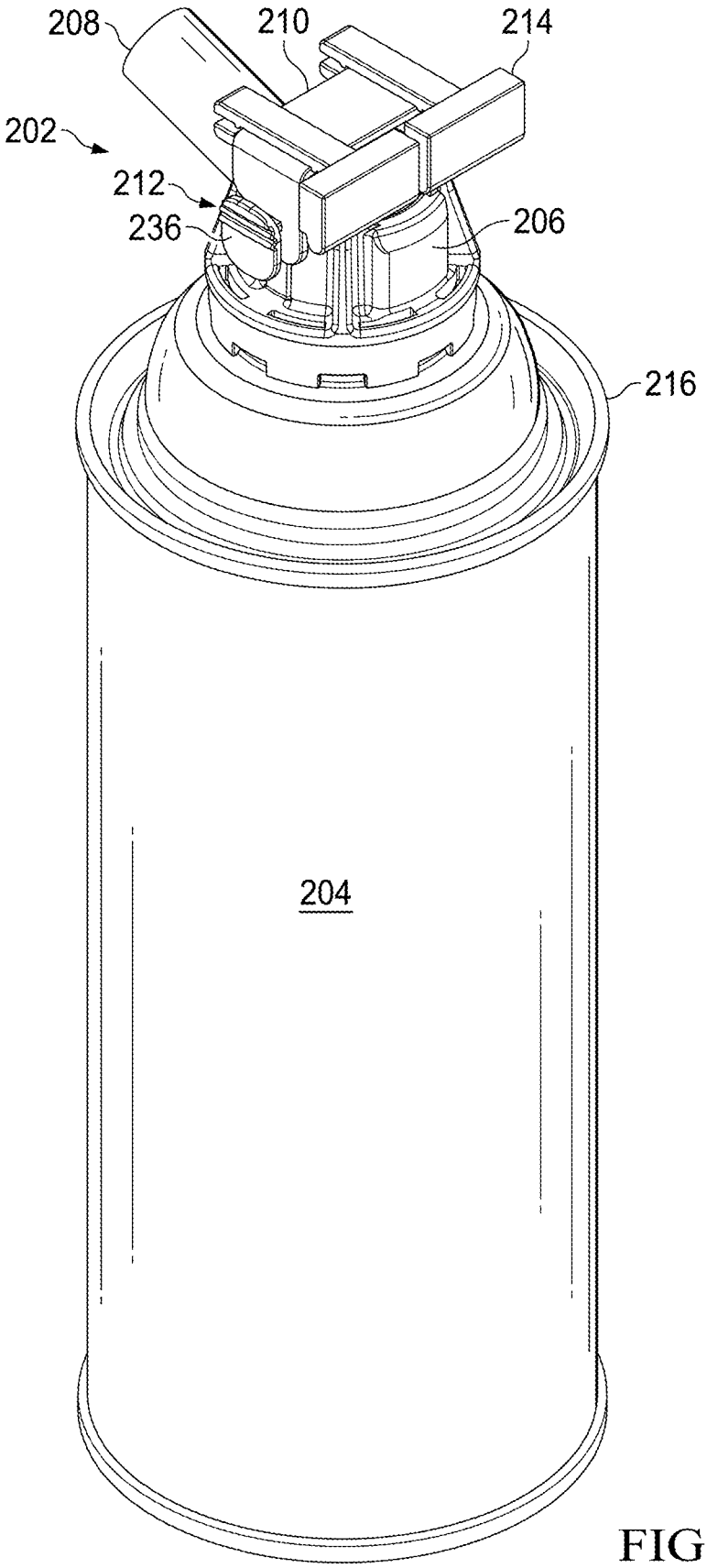
FIG. 7 is a perspective view of another embodiment of an actuator on a canister.

FIG. 6 illustrates the canister 104 with the actuator 102 attached. In this embodiment, the actuator 102 includes a skirt 180 that covers the top of the canister 104 with the actuator housing 106 extending through a hole in the skirt 180. In some embodiments, the skirt 180 is held in place by the actuator housing 106. For example, the skirt 180 may include a snap-fit to engage a protrusion, indention or opening in the actuator housing 106. As another example, the actuator housing 106 may include a flange that holds the skirt 180 against the top of the canister 104 when the actuator housing 106 is attached to the canister 104.

FIGS. 7 through 12 depict another dispenser system for another type of canister 204. The canister 204 holds contents under pressure. When valve stem 220 is pressed down, the contents are discharged. The dispenser system includes an actuator 202 and actuator cover 210. The dispenser system incorporates multiple components that operate similar to the dispenser system disclosed in FIGS. 1 through 6.

In this embodiment, the actuator 202 may engage the valve stem 220 that is built into the canister 204. The dispenser system may receive contents from the canister 204 through the valve stem 220 and directs the outflow of contents from the canister 204 through a tube 208 to a desired location. This embodiment also includes accessory items 214 clipped onto the actuator cover 210.

Figure 8:
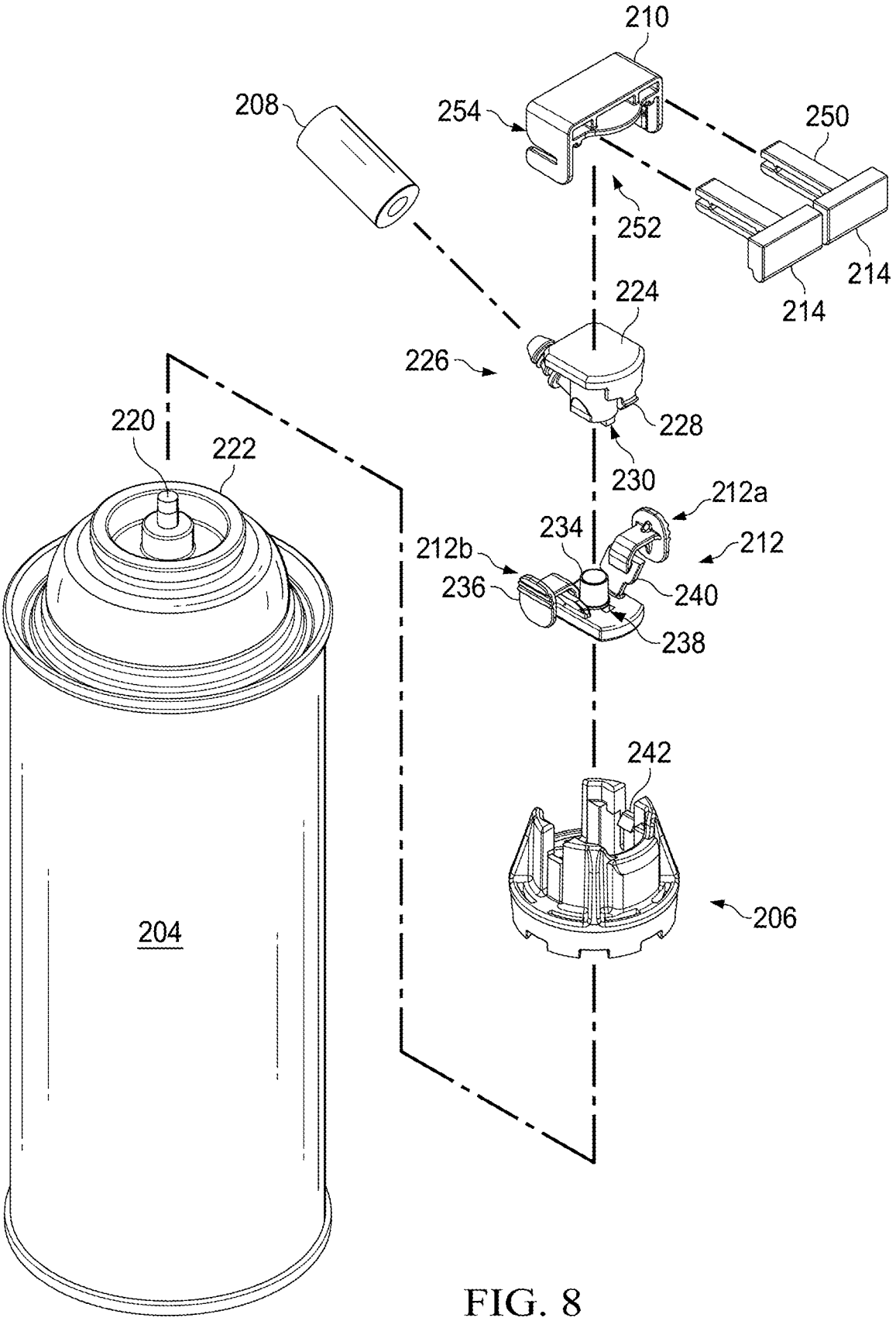
FIG. 8 is an exploded view of another embodiment of an actuator and a canister.

The exploded view in FIG. 8 illustrates the relationship of the various components. In this embodiment, the canister 204 includes a mounting cup 222 with the valve stem 220 extending upward. The actuator 202 includes an actuator housing 206, stem connector 212 and button 224.

The button 224 includes a nozzle 226, a snap fit protrusion 228 and guide 230. The tube 208 connects to the nozzle 226 and the snap-fit protrusion 228 is located on the back of the button 224.

In some embodiments, the stem connector 212 includes a button coupling 234, wings 212*a*, 212*b* including plates 236 and wing protrusions 240. The stem connector 212 also includes a guide hole 238 that corresponds with the guide 230 on the button 224 to assist in aligning the button 224 with the button coupling 234. The stem connector 212 illustrates an alternative embodiment to the stem connector 112. Specifically, stem connector 212 includes a port to fit the canister 204's valve stem 220 and does not include a valve stem 132.

The actuator housing 206 connects to the mounting cup 220 on the canister 204. In some embodiments, the actuator housing 206 includes housing protrusion 242, which corresponds with the wing protrusion 240 on stem connector 212.

The actuator cover 210 includes wing slots 254 that slide over the wings between the plates 236 and the wing protrusions 240. When the actuator cover 210 is in place, the button 224 is protected from inadvertent actuation. The actuator cover 210 also includes openings 252 in the top section that may hold accessory items 214, which may each include an extended clip 250 to grip the openings 252.

The accessory items 214 may contain marketing information or be components for use with the canister 204. For example, the accessory items 214 may be sensor components, such as a tire pressure gauge if the canister 204 is for a tire sealant.

Figure 9:
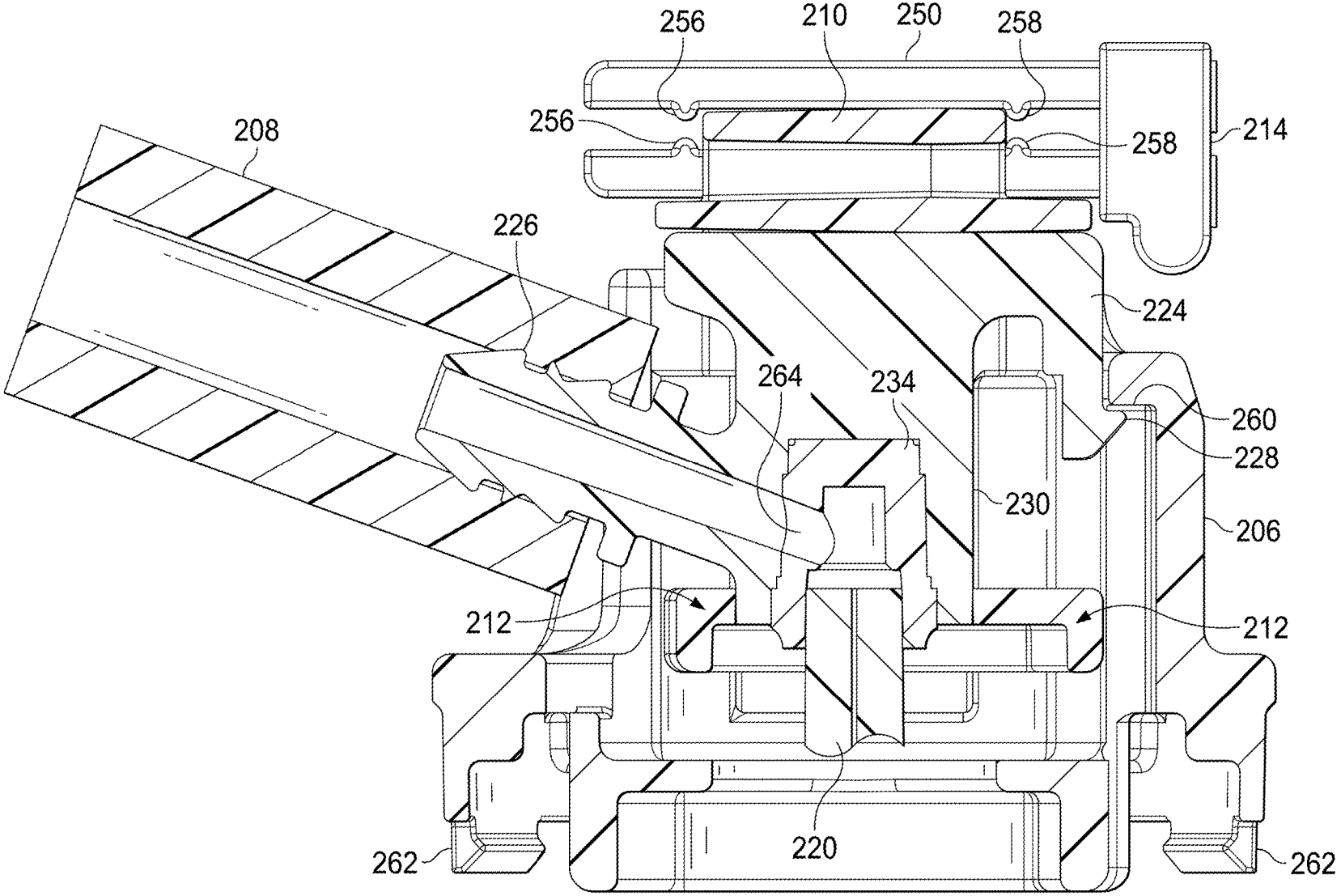
FIG. 9 is a side, cross-section view of an actuator.

FIG. 9 illustrates a side, cross-section view of the assembled actuator 202 with the actuator cover 210. In this embodiment, the actuator 202 is formed by the stem connector 212, the actuator housing 206 and the button 224. The button 224 attaches to the button coupling 234 on stem connector 212 and both are within the actuator housing 206.

The actuator housing 206 includes an extension 260 at the top and back in this embodiment. When the button 224 is pressed into the actuator housing 206, the snap-fit protrusion 228 snaps over the extension 260. The hook of the snap-fit protrusion 228 then catches the extension 260 to prevent or limit the ability of the button 224 to be removed from the actuator housing 206.

In this embodiment, the actuator housing 206 includes hooks 262 at the outer edge of the base that form a snap fit over the outer edge of the valve cup 220 of the canister 204. In some embodiments, the actuator housing 206 may include an additional connection to hold onto the canister 204. For example, the actuator housing 206 may include a threaded connection in some embodiments.

When the actuator 202 is assembled, the button 224 is engaged with the top of the button coupling 234 of the stem connector 212. In this embodiment, the bottom of the button coupling 234 is also configured to engage the canister 204's valve stem 220. The valve stem 220 is used to control the release of contents from the canister 204. The valve stem 220 allows the release of contents when depressed and does not release contents when raised.

When the valve stem 220 is depressed by the button 224, contents from the canister 204 pass through the internal pathway of the valve stem 220 to fluid opening 264 in the side of the button coupling 234. The fluid opening 264 aligns with the internal pathway of the nozzle 226, allowing the contents to pass through the nozzle 226 and into the tube 208.

The actuator cover 210 is located over the button 224. When the actuator cover 210 is in place, the button 224 and stem connector 212 are held in a raised position to prevent accidental or inadvertent release of the contents of the canister 204. In addition, the actuator cover 210 may limit the ability to tamper with the canister 204 to release the contents. The wing slots 254 of the actuator cover 210 may prevent the wings from being compressed due to the width of the actuator cover 210.

The accessory item 214 is clipped into the opening 252 with one arm of the extended clip 250 above the actuator cover 210 and the second arm in the opening 252. The extended clip 250 includes corresponding protrusions 256 on each arm, which coordinate to grip the actuator cover 210.

Figure 10:
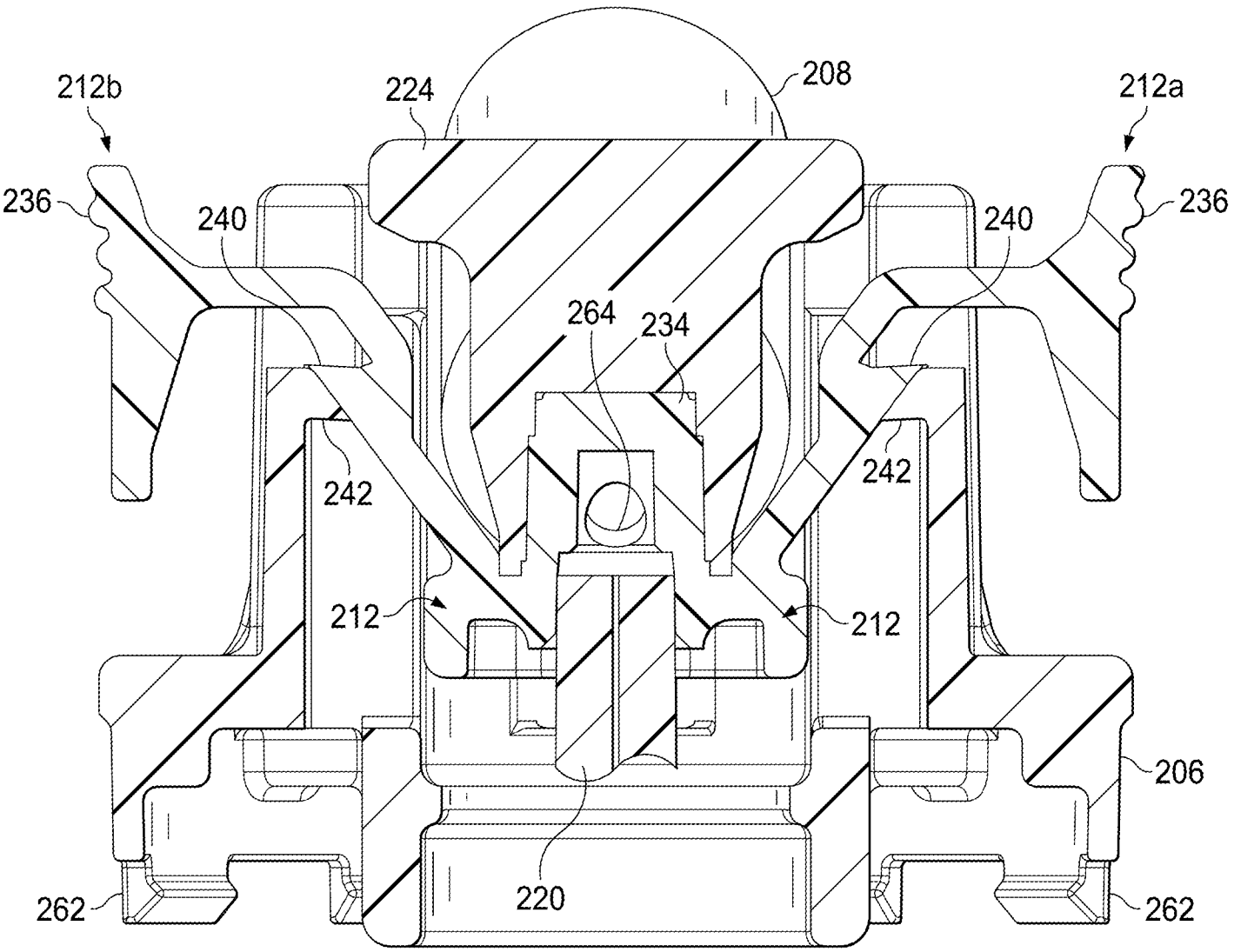
FIG. 10 is a back, cross-section view in a first position.
Figure 11:
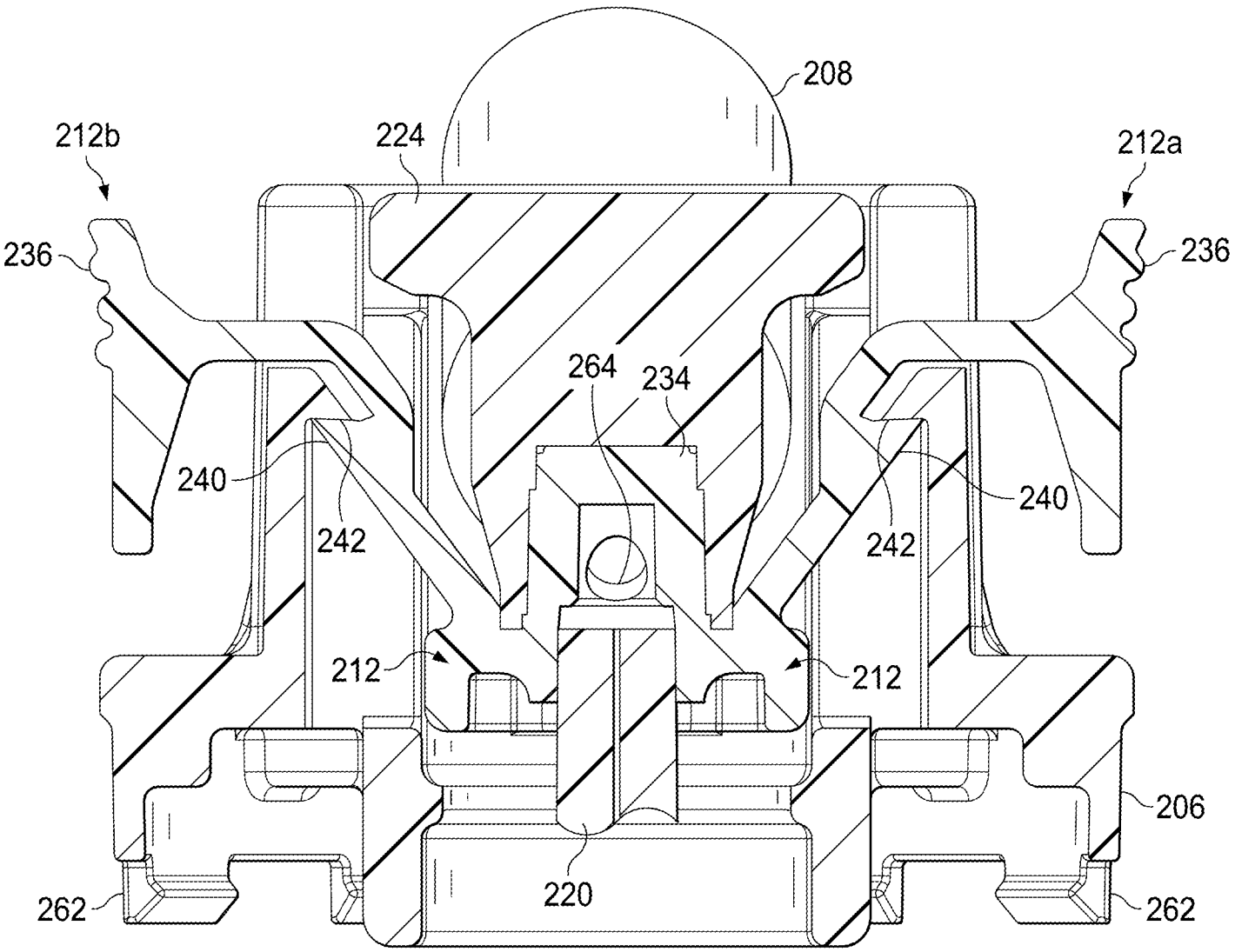
FIG. 11 is a back, cross-section view in a second position.

FIGS. 10 and 11 illustrate back, cross-section views in a raised position (FIG. 10) and a depressed position (FIG. 11). In these views, the actuator cover 210 has been removed to allow access to the button 224 and allow the wings to compress in order to lower or raise the button 224. The actuator housing 210 is shown with a pair of housing protrusions 242, which correspond with the wing protrusions 240. In some embodiments, the housing protrusions 242 form a hook feature with a wider base than top. Similarly, the wing protrusions 240 form an opposing hook feature with a wider top than base. The abutting sides of the protrusions 240 and 242 are angled to allow the wings to slide downward when the button 224 is pressed.

As shown in FIG. 11, once the wing protrusions 240 pass the housing protrusions 242, the wings expand, causing the hook features to engage and prevent the button 224 or stem connector 212 from returning to a raised position automatically. When the wing protrusions 240 and housing protrusions 242 are engaged, the actuator 202 continues to release the contents from the canister 204 without requiring the user to hold the button 224 down.

A user may stop the release of contents from the canister 204 by pressing the plates 236 inward, causing the wing protrusions 240 to disengage the housing protrusions 242. Once disengaged, the pressure from the canister 204 may push the stem connector 212 upward absent any downward pressure applied by the user. The contents will stop dispensing from the canister 204 when the stem connector 212 returns to the raised position.

Figure 12:
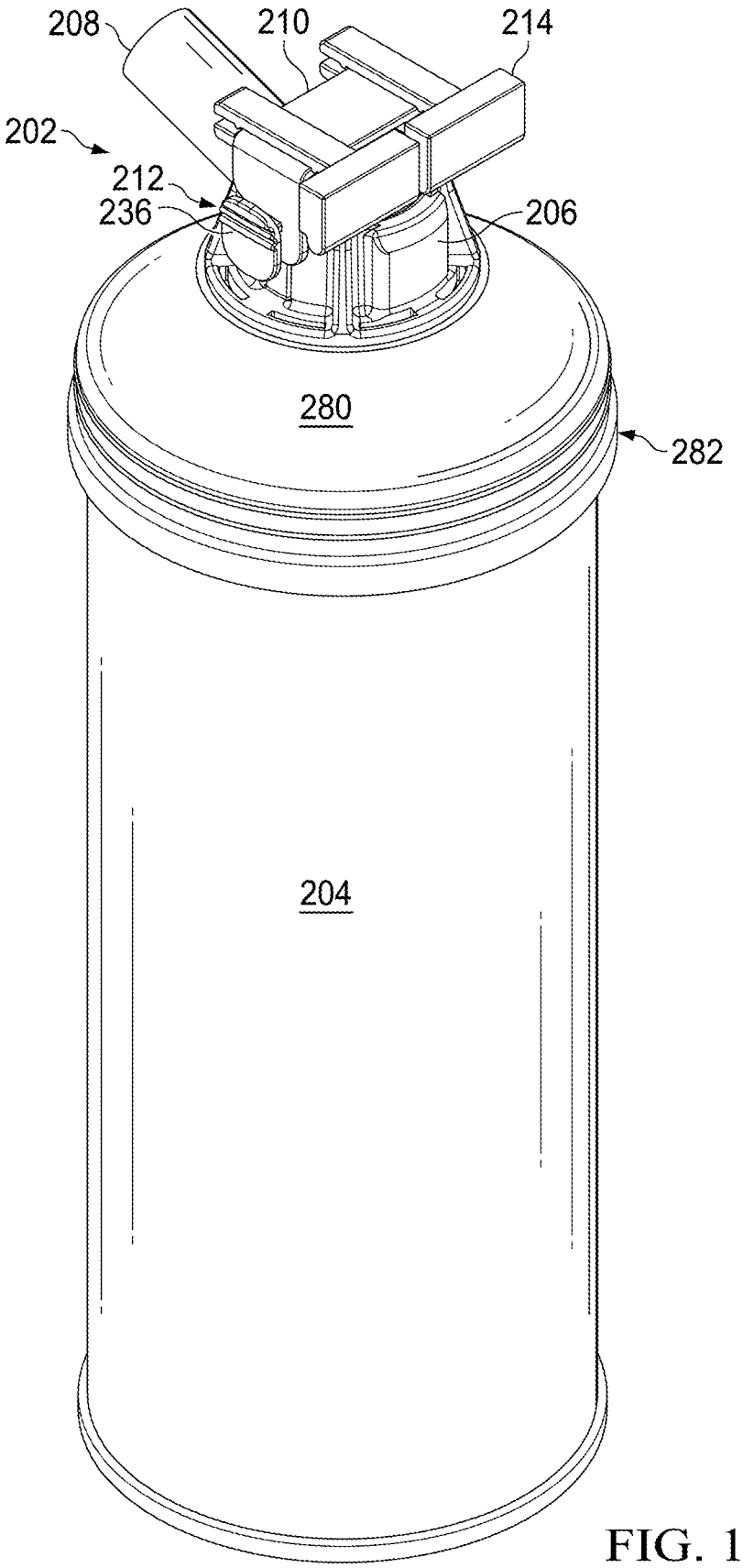
FIG. 12 is a perspective view of an embodiment of an actuator with a shroud on a canister.

FIG. 12 illustrates the canister 204 with the actuator 202 attached. In this embodiment, the actuator 202 includes a skirt 280 that covers the top of the canister 204 with the actuator housing 206 extending through a hole in the skirt 280. In some embodiments, the skirt 280 is held in place by the actuator housing 206. For example, the skirt 280 may include a snap-fit to engage a protrusion, indention or opening in the actuator housing 206. In some embodiments, the actuator housing 206 may include a flange that holds the skirt 280 against the top of the canister 204 when the actuator housing 206 is attached to the canister 204. The skirt 280 may include an outer flange 282 that snaps onto a canister rim in some embodiments.

In some embodiments, the canister 204 may contain a tire sealant designed to re-inflate a flat tire and seal leaks in the tire. The user may need to fix a flat tire while on the side of the road using the tire sealant. The user may remove any cap from the canister 204 to access the tube 208. The distal end of the tube 208 may include a connector to attach to a tire's air valve. The actuator cover 210 may be removed once the tube 208 is connected to the tire's air valve. The button 224 is then pressed down to open the valve stem 220, allowing the tire sealant to move from the canister 204 to the tire. The wing protrusions 240 also snap in place below the housing protrusions 242 to lock the stem connector 212 in a depressed state and the valve stem 220 open to allow the continued flow of the tire sealant without requiring the user to hold the button 224. This allows a user to set the canister 204 down and move to a safer location if needed while the tire sealant continues to flow. For example, the user may be able to move away from an active street.

As illustrated in these two embodiments, the actuators 102 and 202 may be part of an actuator system that uses universal components and interchangeable elements. In these embodiments, the actuator covers 110 and 210, buttons 124 and 224 and tubes 108 and 208 are the same.

The stem connectors 112 and 212 are different to correspond with different canisters 104 and 204. Specifically, stem connector 112 includes an extended valve stem 132 while stem connector 212 is designed to engage an extended valve stem 220 from the canister 204.

In addition, the actuator housings 106 and 206 are different to fit the distinct connections to the canisters 104 and 204. Specifically, actuator housing includes a threaded connection 166, which is not included in the actuator housing 206.

This system of component pieces allows better inventory management by allowing the same component pieces to work on multiple configurations and limiting the need to store many different individual actuators for each possible canister type. Instead a few limited component pieces may be kept on hand to fit distinct canisters, while the remaining pieces are the same for each actuator.

In some embodiments, the actuator assembly may include a self-contained valve and hose assembly. For example, the tube 108 or 208 may be packed within a canister cap that fits over the actuator 102 or 202. As another example, the skirt 180 or 280 may include a tube holder to keep the tube 108 or 208 from unwinding even without a cap. Examples of self-contained valve and hose combinations are taught in U.S. Pat. No. 6,260,739, which is incorporated herein by reference.

Figure 13:
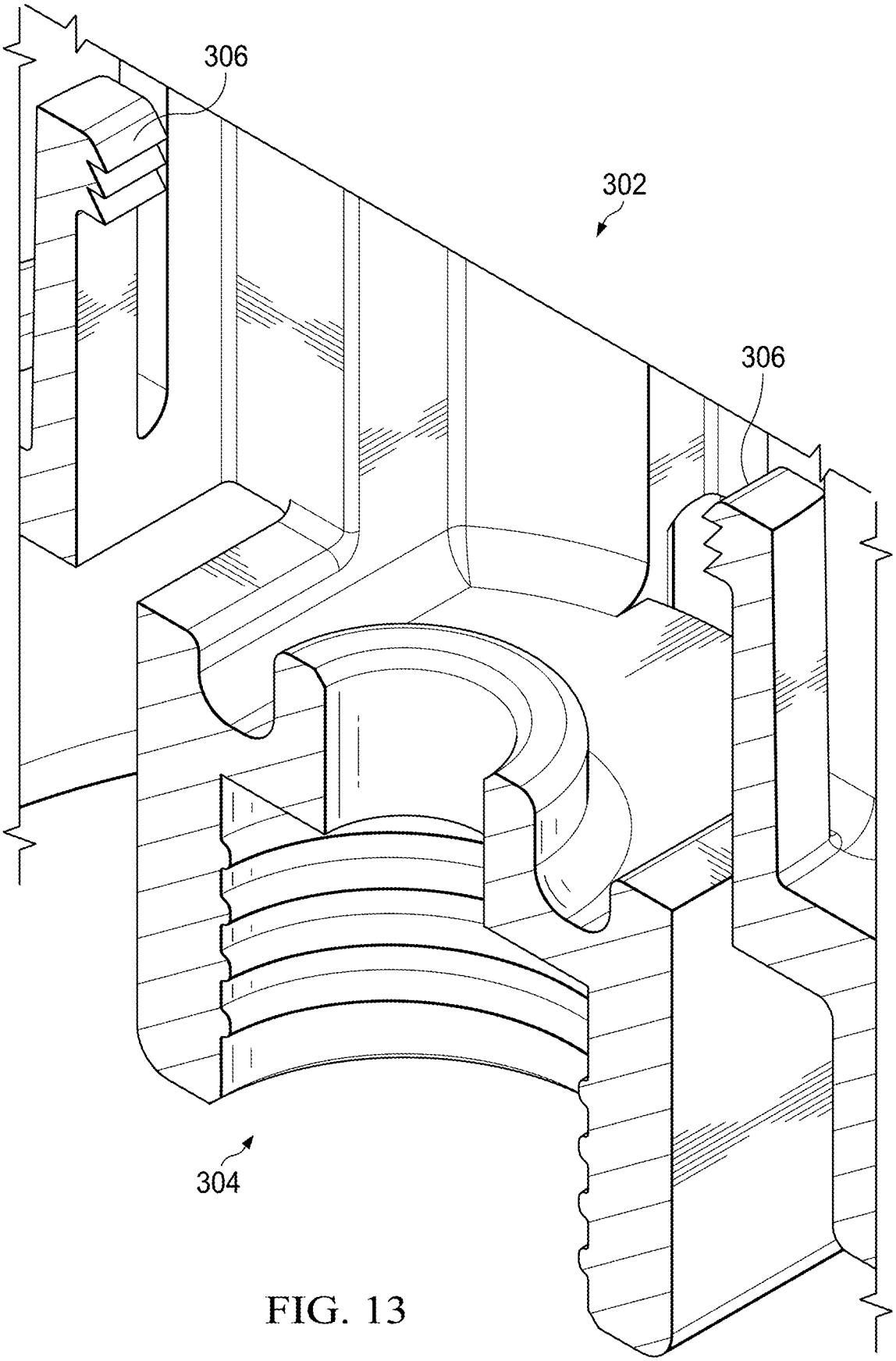
FIG. 13 is an enlarged cross-section view of an embodiment of an actuator housing.

FIG. 13 shows an enlarged cutaway view of an alternative actuator housing 302. As shown in other embodiments, the actuator housing 302 is designed to accept a stem connector and button configured to operate a canister output.

The bottom of the actuator housing 302 includes a canister connector 304, which is shown with threads in this embodiment. The canister connector 304 may be any connector including friction fit, snap-on connector, threaded connector or other connector. In some embodiments, the canister connector 304 may be replaced with a fitting and an alternative connector may be used to connect the actuator housing 302 to the canister.

This actuator housing 302 includes a multi-prong housing protrusion 306. This is an alternative to the housing protrusions in the earlier embodiments shown with a single protrusion. The multi-prong housing protrusion 306 provides variability in the locking position for a stem connector. In some embodiments, the multi-prong housing protrusions 306 may be part of a side wall of the actuator housing 302 or on a separate wall section, which may allow more flexibility.

Figure 14:
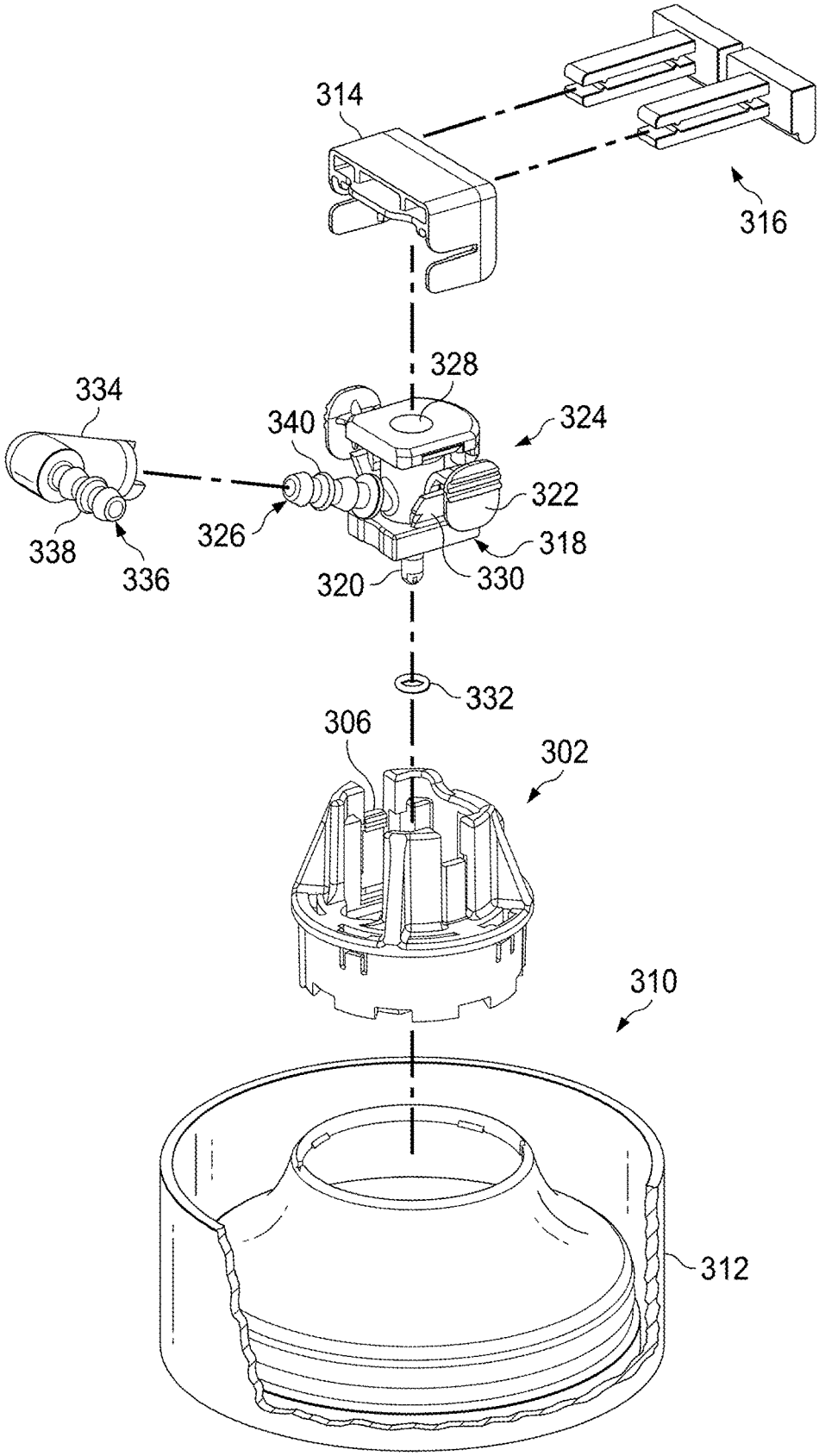
FIG. 14 is an exploded view of an actuator assembly.
Figure 15:
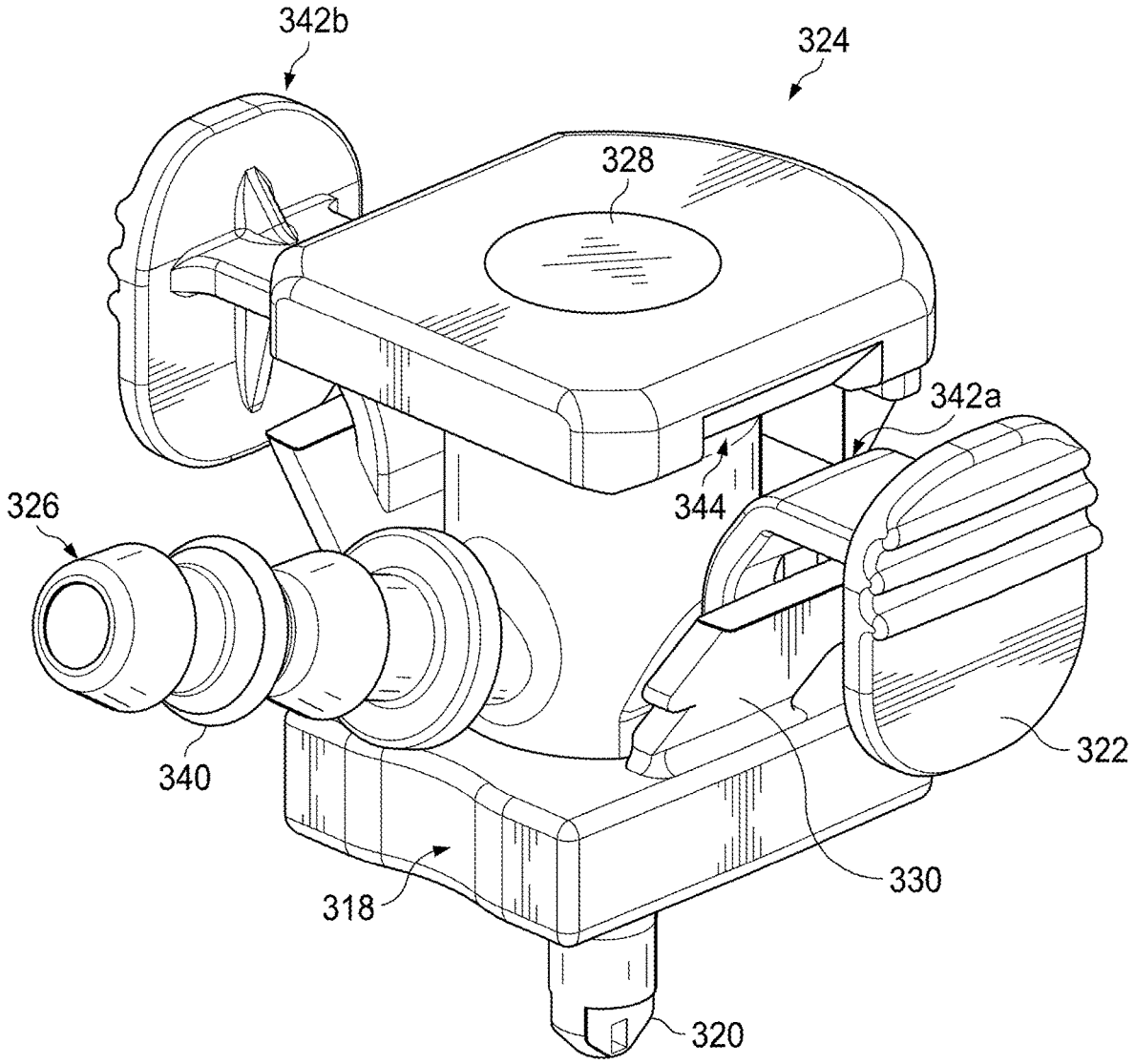
FIG. 15 is a perspective view of an embodiment of another button and stem connector.

FIG. 14 shows an exploded version of an actuator system incorporating actuator housing 302. The actuator system includes a skirt 310, the actuator housing 302, a stem connector 318 with a connected button 324, an actuator cover 314 with accessory items 316 and a nozzle extension 334. An enlarged view of the stem connector 318 with the button 324 attached is shown in FIG. 15.

The skirt 310 is designed to fit over the top of a canister (not shown). The skirt 310 may directly connect to the canister or be held to the canister by the actuator housing 302 or other component. In this embodiment, the skirt 310 includes a wall 312 extending upward around the exterior circumference of the skirt. In some embodiments, the hose 312 may be wrapped within the wall 312. This may keep the hose within the circumference of the canister throughout manufacture, shipping and storage to minimize space and reduce the likelihood that the hose gets damaged. In addition, the design may eliminate the need for a cap over the top of the canister.

This embodiment shows the stem connector 318 attached to the button 324. In some embodiments, the stem connector 318 and button 324 may be part of the same component. The stem connector 318 includes the valve stem 320 configured to extend into a canister's top and control the output of the canister's contents. This embodiment includes a seal 332, such as an O-ring, to seal the connection between the valve stem 320 and the canister.

In addition, the stem connector 318 includes wings 342*a*, 342*b* (see FIG. 15) having wing protrusions 330 and end plates 322. The wing protrusions 330 correspond with the multi-prong housing protrusions 306. When the stem connector 318 and the button 324 are pressed down within the actuator housing 302, the wing protrusions 330 move down the multi-prong housing protrusions 306 to initiate the release of contents from the canister. When pressure to the button 324 is removed, the wings 342*a*, 342*b* expand to engage one of the prongs of the multi-prong housing protrusions 306, thereby holding the stem connector 318 in the engaged position to allow continued release of the contents.

The plates 322 may be pressed together to disengage the wing protrusions 330 from the multi-prong housing protrusions 306. This embodiment includes recesses 344 (see FIG. 15) in the button top to allow the wings 342 additional room to flex toward each other when the plates 322 are pressed together.

In some embodiments, the wing protrusions 330 may include multiple prongs. The multiple prongs on the wing protrusions 330 may engage a single prong housing protrusion in some embodiments to provide flexibility in the positioning. In some embodiments, the wing protrusions 330 may include multiple prongs to engage the multi-prong housing protrusions 306.

In this embodiment, the button 324 includes a viewer 328. The viewer 328 allows the user to view the flow of contents through the stem connector 318 and button 324. In some embodiments, the viewer 328 may be glass, plastic, acrylic or other type of material that is clear to allow visibility of the contents. In some embodiments, the material may be colored or configured to magnify the fluid flow or otherwise provide a clear indication of flow. For example, the material may be configured with a lens that changes color based on the flow or a chemical characteristic of the canister's contents.

This embodiment also includes a nozzle 326 extending from the button 324. The nozzle 326 includes a seal 340, such as an O-ring, to improve the seal with a hose or other connector, such as the nozzle extension 334 shown in this embodiment. The nozzle extension 334 is a 90-degree connector. The port side of the nozzle extension 334 fits over the nozzle 326 of the button 324. The second end includes a hose connection 336 with a seal 338. The seals 340 and 338 may be any seal or element to seal the connections with extensions, hoses or other features. During operation, the canister's contents pass through the valve stem 320 and into the nozzle 326 when released by actuation of the button 324. The contents' movement through the button 324 is visible through the viewer 328. The contents pass from the nozzle 326 into the nozzle extension 334 and out to a hose or other output feature.

In this embodiment, the nozzle extension 334 can rotate to modify the output direction. The nozzle extension 334 may be rotated to the side during operation to guide the hose into a wrapped position between the interior wall of the skirt 310 and the outer wall 312. During operation, the nozzle extension 334 may be rotated to an upward angle to guide the hose or other connecting feature upward and outside of the wall 312.

In some embodiments, the nozzle extension 334 may have a different shape or feature. For example, the nozzle extension 334 may have a different angle, such as a 45-degree angle or any angle up to 180 degrees. In some embodiments, the nozzle extension 334 may include a flexible joint or section to allow the nozzle extension 334 to adjust the angle.

The embodiments being thus described and further described in the claims, it will be obvious that the same may be varied in many ways. Such variations are not to be regarded as a departure from the spirit and scope of the embodiments described and all such modifications as would be obvious to one skilled in the art are intended to be included within the scope of the apparatus described.

The invention claimed is:

1. A dispenser system for a canister, comprising:

an actuator that controls flow of contents from the canister, the actuator comprising:

an actuator housing defining an open area, the actuator housing having a canister connection and a vertical wall having a housing protrusion extending inward, a stem connector having a wing with a wing protrusion and a button coupling including an output opening, wherein the stem connector operably connects to an output of the canister, and a button with an output nozzle and a port to engage the button coupling, wherein the output opening aligns with the output nozzle;

wherein when the actuator is in a first position, the contents do not flow out of the canister and the housing protrusion and the wing protrusion are not engaged;

wherein when the actuator is in a second position, the actuator causes the contents to flow out of the canister and the wing protrusion engages the housing protrusion, and wherein when the wing protrusion and the housing protrusion are engaged, the actuator is held in the second position; and wherein pressing the wing causes the wing protrusion to disengage from the housing protrusion, allowing the actuator to return to the first position.

2. The dispenser system for the canister of claim 1, further comprising an actuator cover having a wing slot that fits around the wing and prevents pressing of the button.

3. The dispenser system for the canister of claim 2, further comprising an accessory item that attaches to the actuator cover.

4. The dispenser system for the canister of claim 1, further comprising an actuator skirt that covers at least a portion of a top of the canister.

5. The dispenser system for the canister of claim 4, wherein the actuator skirt includes a wall extending upward from an outer edge of the canister.

6. The dispenser system for the canister of claim 1, wherein the stem connector includes a valve stem that extends into the output of the canister.

7. The dispenser system for the canister of claim 1, wherein the bottom of the button coupling is a stem port configured to engage a valve stem that extends from the canister, wherein the valve stem is the output of the canister.

8. The dispenser system for the canister of claim 1, wherein the canister connection comprises a hook that holds onto a mounting cup on the canister.

9. The dispenser system for the canister of claim 1, wherein the canister connection comprises a threaded connection.

10. The dispenser system for the canister of claim 1, wherein the button includes a snap fit protrusion that corresponds to an extension on the actuator housing, wherein when the actuator is assembled, the snap fit protrusion holds the button and the stem connector within the actuator housing.

11. The dispenser system for the canister of claim 1, wherein the housing protrusion includes multiple prongs extending inward, wherein the wing protrusion may engage any one of the multiple prongs.

12. The dispenser system for the canister of claim 1, wherein the button includes a viewer, wherein the viewer is positioned to allow visibility of the contents flowing through the canister.

13. A dispenser system for a canister, comprising:

an actuator that controls flow of contents from the canister, the actuator comprising:

an actuator housing defining an open area, the actuator housing having a canister connection and a vertical wall having a housing protrusion with multiple prongs extending inward, a button including a stem connector and output nozzle, wherein the stem connector includes a wing having a wing protrusion and the stem connector operably connects to an output of the canister;

wherein when the actuator is in a first position, the contents do not flow out of the canister and the housing protrusion and the wing protrusion are not engaged;

wherein when the actuator is in a second position, the actuator causes the contents to flow out of the canister and the wing protrusion engages one of the multiple prongs of the housing protrusion, and wherein when the wing protrusion and the housing protrusion are engaged, the actuator is held in the second position; and wherein compressing the wing causes the wing protrusion to disengage from the housing protrusion, allowing the actuator to return to the first position.

14. The dispenser system for the canister of claim 13, further comprising an actuator cover having a wing slot that fits around the wing and prevents pressing of the button.

15. The dispenser system for the canister of claim 13, further comprising an actuator skirt that covers at least a portion of a top of the canister.

16. The dispenser system for the canister of claim 15, wherein the actuator skirt includes a wall extending upward from an outer edge of the canister.

17. The dispenser system for the canister of claim 13, wherein the stem connector includes a valve stem that extends into the output of the canister.

18. The dispenser system for the canister of claim 13, wherein a bottom of the button includes a stem port configured to engage a valve stem that extends from the canister, wherein the valve stem is the output of the canister.

19. The dispenser system for the canister of claim 13, wherein the canister connection comprises a threaded connection.

20. The dispenser system for the canister of claim 13, wherein the button includes a viewer, wherein the viewer is positioned to allow visibility of the contents flowing through the canister.

21. A dispenser system for dispensing of contents from a canister comprising:

a first position for limiting the flow of contents from the canister when an actuator having an actuator housing with a canister connection is engaged with the canister, and a housing protrusion extending from the actuator housing is disengaged from a wing protrusion of a stem connector of the actuator, operably connected to an output of the canister at an output opening in the stem connector;

a second position for causing the flow of contents out of the canister when the wing protrusion of the stem connector engages the housing protrusion of the actuator housing to hold the actuator in the second position, and the contents to flow from the output of the canister through the output opening in the stem connector and an output nozzle in a button of the actuator aligned with the output opening in the stem connector; and wherein disengaging the wing protrusion of the stem connector from the housing protrusion of the actuator housing returns the actuator to the first position.

22. The dispenser system of claim 21, further comprising an actuator cover for covering the button of the actuator and preventing movement of the wing protrusion into engagement with the housing protrusion.

* * * * *